US005955167A

United States Patent [19]

Onishi et al.

[11] Patent Number: 5,955,167

[45] Date of Patent: Sep. 21, 1999

[54] RECORDING MEDIUM WITH ADHESIVE LAYER

[75] Inventors: Hiroyuki Onishi; Junichi Iida, both of Suwa; Tetsuyuki Utagawa, Kawaguchi, all of Japan

[73] Assignees: Lintec Corporation; Seiko Epson Corporation, both of Tokyo-to, Japan

[21] Appl. No.: 08/818,659

[22] Filed: Mar. 14, 1997

[30] Foreign Application Priority Data

Mar. 15, 1996 [JP] Japan ..... 8-087179

[51] Int. Cl.[6] ..... B41M 5/00

[52] U.S. Cl. ..... 428/41.5; 347/105; 347/106; 428/41.6; 428/41.8; 428/195

[58] Field of Search ..... 347/105, 101, 347/106; 428/195, 41.5, 41.6, 41.8

[56] References Cited

U.S. PATENT DOCUMENTS 5,514,435 5/1996 Suzuki et al. ..... 428/40

*Primary Examiner*—Bruce H. Hess
*Attorney, Agent, or Firm*—Ladas & Parry

[57] ABSTRACT

A recording medium and a recording method are provided which, in a printer comprising a recording head for performing recording without contact with a recording medium and means for changing the carrying direction of the recording medium, can effectively prevent contact of a recording medium with a recording head. The recording medium comprises: a recording sheet; an adhesive layer provided on one side of the recording sheet; and a release sheet provided on the adhesive layer, the recording medium having a Gurley stiffness of 200 to 1500 mgf, the adhesive layer comprising a crosslinked acrylic polymer, the recording medium being such that, in a holding power test according to JIS-Z-0237, the time taken for causing a test piece of the recording medium to drop from an adherend is 500 min or more, or when the time taken for causing a test piece of the recording medium to drop from an adherend is less than 500 min, the test piece drops as a result of coming off at the interface between the adherend and the adhesive layer.

11 Claims, 5 Drawing Sheets

RECORDING MEDIUM WITH ADHESIVE LAYER

BACKGROUND OF THE INVENTION

1. Field of the Invention

The present invention relates to a recording sheet, with an adhesive layer, for recording by means of a printer.

2. Background Art

Printers for use in recording onto a recording medium are classified into those wherein, at the time of recording, a recording head is brought into contact with the recording medium and those wherein recording is performed without contact of the recording head with the recording medium.

On the other hand, printers having means for changing the direction of carrying of the recording medium within a printer are mainly used from the viewpoint of a reduction in size of printers. For example, printers having means for winding a recording medium around a drum to change the direction of carrying of the recording medium are known in the art.

In the printers comprising means, for changing the direction of carrying of the recording medium, and a non-contact type recording head, a recording medium often comes into contact with the recording head. Such contact of the recording medium with the recording head is significant in the case of a recording medium with an adhesive.

The contact of the recording medium with the recording head is causative of smearing of prints, recording head trouble and the like, and it is desirable, therefore, to prevent such a phenomenon.

SUMMARY OF THE INVENTION

The present inventors have now found that a combination of a printer comprising a recording head, which performs printing without contact with a recording medium, and means for changing the direction of carrying of the recording medium within the printer with a specific recording medium can effectively prevent the content of the recording medium with the recording head. The present invention has been made based on such finding.

Accordingly, an object of the present invention is to provide a recording medium which is less likely to come into contact with a recording head within a printer.

Another object of the present invention is to provide a recording method which is less likely to cause contact of a recording medium with a recording head.

According to one aspect of the present invention, there is provided a recording medium comprising: a recording sheet; an adhesive layer provided on one side of the recording sheet; and a release sheet provided on the adhesive layer, said recording medium having a Gurley stiffness of 200 to 1500 mgf, said adhesive layer comprising a crosslinked acrylic polymer, said recording medium being such that, in a holding power test according to JIS-Z-0237, the time taken for causing a test piece of the recording medium to drop from an adherend is 500 min or more, or when the time taken for causing a test piece of the recording medium to drop from an adherend is less than 500 min, the test piece drops as a result of coming off at the interface between the adherend and the adhesive layer.

According to another aspect of the present invention, there is provided a method for recording onto a recording medium, comprising the steps of: introducing the above recording medium according to the present invention into a printer comprising a recording head for performing recording without contact with a recording medium and means for changing the carrying direction of the recording medium while drawing a circular arc within the printer, the circular arc having a central angle of about 120 to about 2000 and a radius of about 10 to about 50 mm; and performing recording onto the recording medium by means of the recording head.

DETAILED DESCRIPTION OF THE INVENTION

Figure 1:
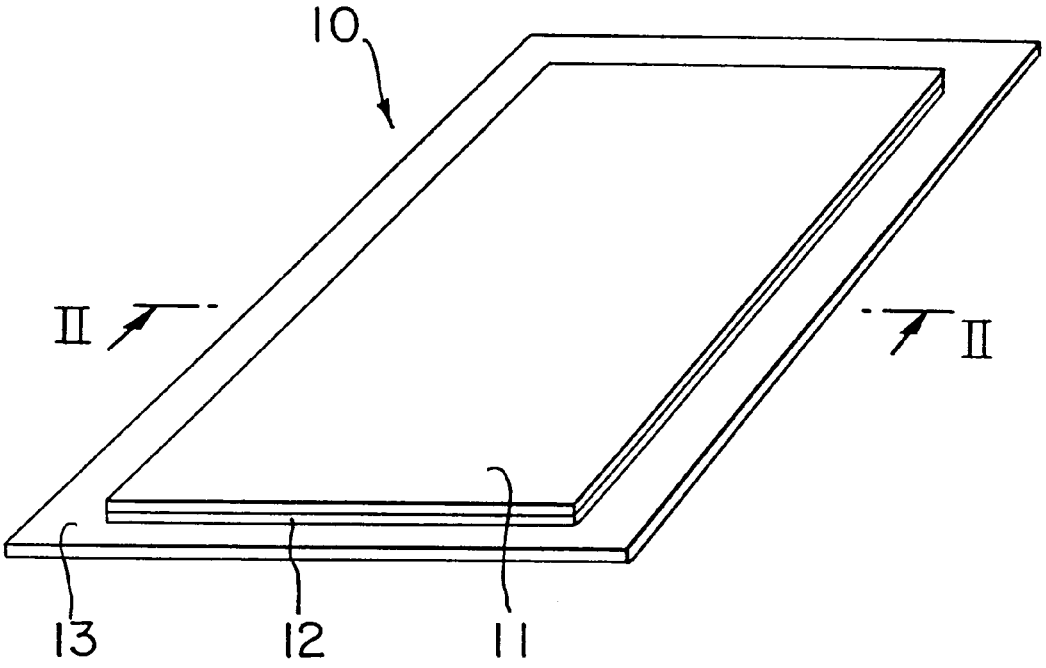
FIG. 1 is a perspective view showing one embodiment of the recording sheet according to the present invention.
Figure 2:
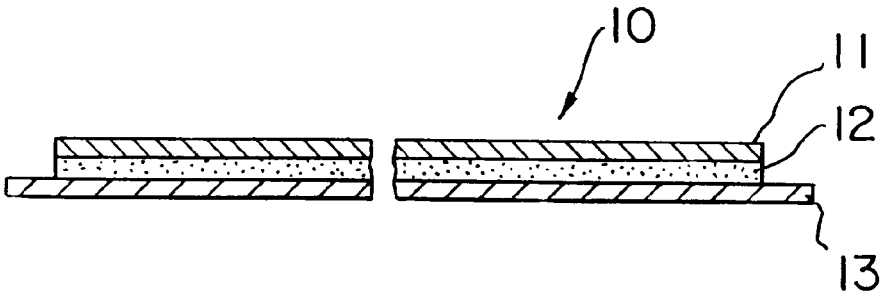
FIG. 2 is a cross-sectional view taken on line II—II of FIG. 1.

A preferred embodiment of the recording medium according to the present invention is shown in FIG. 1. FIG. 2 is a cross-sectional view taken on line II—II of FIG. 1.

As shown in the drawings, a recording medium 10 comprises a recording sheet 11, an adhesive layer 12 provided on the backside of the recording sheet, and a release sheet 13 applied to the adhesive layer 12. The recording medium of the present invention, after the release sheet 13 is peeled off, may be applied through the adhesive layer 12 to a suitable place.

For the recording medium of the present invention, the Gurley stiffness, preferably the Gurley stiffness in the direction of carrying of the recording medium in a printer is about 200 to 1500 mgf, preferably about 400 to 1,000 mgf.

Further, the recording medium of the present invention is such that, in a holding power test according to JIS-Z-0237, the time taken for causing a test piece of the recording medium to drop from an adherend is 500 min or more, or when the time taken for causing a test piece of the recording medium to drop from an adherend is less than 500 min, the test piece drops as a result of separation at the interface between the adherend and the adhesive layer. In this case, the recording medium is considered to drop in the following three forms: (1) dropping as a result of coming off at the interface between an adherend used in the test and the adhesive layer 12, (2) dropping as a result of coming off within the adhesive layer 12, and (3) dropping as a result of coming off at the interface between the recording sheet 11 and the adhesive layer 12. However, the dropping form (3) means that the adhesive layer 12 is likely to separate from the recording sheet 11 and, hence, is unfavorable. Therefore, in the test, the recording sheet of the present invention should drop as a result of the form (1) or (2).

The recording medium satisfying the above Gurley stiffness requirement and the requirement in the holding power test can effectively prevent the contact of the recording medium with the recording head in a printer comprising a recording head for performing recording without contact with the recording medium and means for changing the direction of carrying of the recording medium, resulting in the formation of a proper image. According to the present invention, the means for changing the direction of carrying of the recording medium is preferably one which changes the direction of carrying of the recording medium while drawing a circular arc within the printer, the circular arc having a central angle of about 120 to about 200°, preferably about 130 to about 190°, and a radius of about 10 to about 50 mm, preferably about 12 to about 30 mm.

Figure 3:
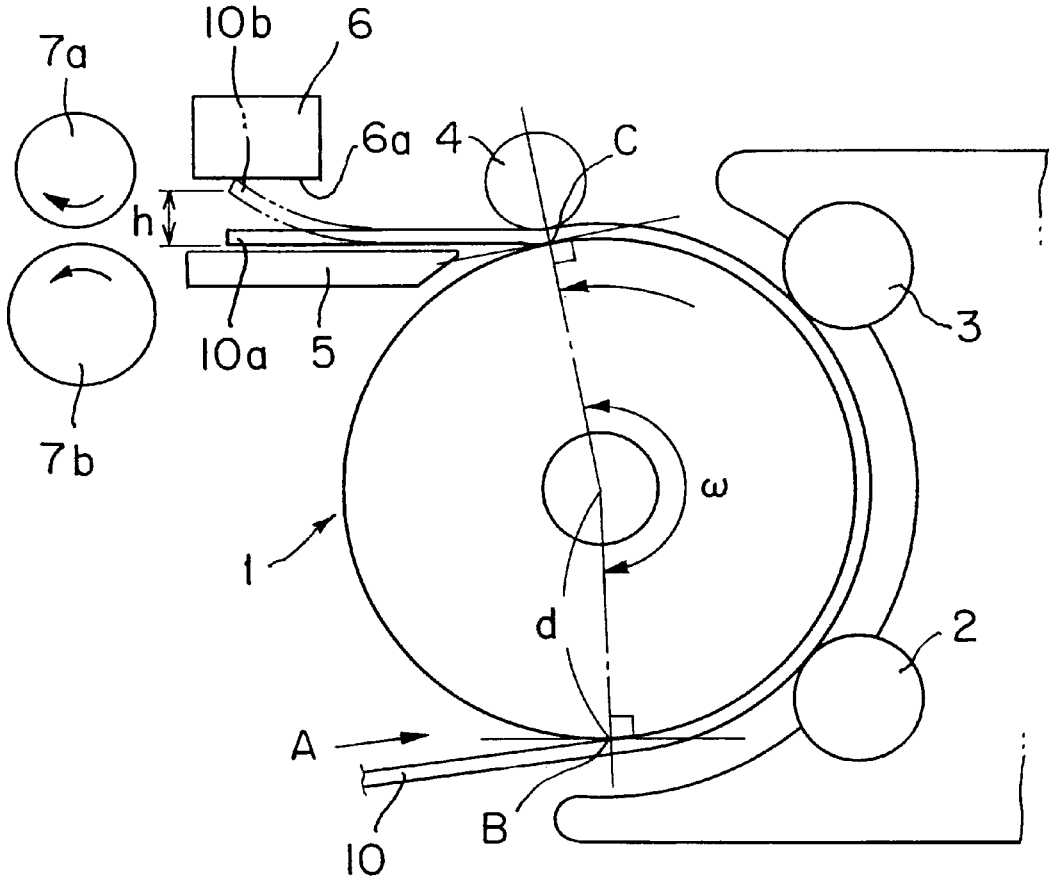
FIG. 3 is a schematic diagram showing an embodiment of a printer comprising a recording head, for performing recording without contact with a recording medium, and means for changing the direction of carrying of the recording medium.

FIG. 3 is a schematic diagram showing an embodiment of a printer comprising a recording head, for performing recording without contact with a recording medium, and means for changing the direction of carrying of the recording medium.

The printer shown in FIG. 3 comprises a sheet feed roller 1, a pressure contact rollers 2, 3, 4 in pressure contact with the sheet feed roller 1, a sheet guide 5, a non-contact type recording head 6, for example, an ink jet recording head 6, and, further, delivery rollers 7*a* and 7*b*. In this printer, a recording medium 10 is fed in a direction indicated by an arrow a by means of a sheet feed means (not shown) toward the sheet feed roller 1. The recording medium 10 is carried while being brought to intimate contact with and wound around the sheet feed roller 1 by taking advantage of the pushing force created by the pressure contact rollers 2, 3 and 4. The front and 10*a* of the recording medium 10, upon passage through between the pressure contact roller 4 and the paper feed roller 1, is separated from the sheet feed roller 1, and guided below the recording head 6 by means of the sheet guide 5. Then, the formation of an image is initiated using a recording agent from the head 6 (ejected ink droplets in the case of ink jet recording). Further advance of the recording medium permits the front end 10*a* of the recording medium 10 to enter between the delivery rollers 7*a* and 7*b*, and recording is further performed, while the recording medium 10 is delivered.

In the recording medium shown in FIG. 3, means for changing the direction of carrying of the recording medium comprises the paper feed roller 1, the pressure contact rollers 2, 3 and 4 in pressure contact with the paper feed roller 1.

The construction of the means for changing the direction of carrying of the recording medium is not limited to the above one so far as the direction of carrying of the recording medium is changed while drawing a circular arc. In the printer shown in FIG. 3, the circular arc is one extended from a point B, in the drawing, where the recording medium 10 for the first time comes into contact with the sheet feed roller 1, to a point C, in the drawing, where the recording medium 10 is released from the force, created by the sheet feed roller 10, for changing the direction of carrying of the recording medium. In the drawing, the central angle of the circular arc is represented by ω. The radius of the circular arc is substantially identical to the radius d of the sheet feed roller 1.

In the present invention, the circular arc refers to not only one constituted by a part of a true circle but also one constituted by an ellipse. According to the present invention, in the case of the circular arc constituted by a part of the ellipse, the circular arc may be regarded as one having a radius intermediate between the major axis and the minor axis.

Use of the recording medium according to the present invention enables recording to be performed without contact of the front end 10*a* of the recording medium 10 with the recording head 6 in its surface 6*a* facing the recording medium 10, and the front end 10*a* enters between the delivery rollers 7*a* and 7*b*. As shown in FIG. 10*b*, if the front end of the recording medium 10 is in a warped state, a suitable space cannot be ensured between the recording head and the recording medium 10, causing a fear of forming an unacceptable image. Further, in this case, a material separated from the recording medium 10 is adhered to the surface 6*a* of the recording head 6, causative of trouble of the recording head 6. When the warpage of the front end is in a certain acceptable range, the recording medium 10 enters between the delivery rollers 7*a* and 7*b*, while when the warpage is significantly large, the recording medium 10 cannot enter between the delivery rollers 7*a* and 7*b*, often resulting in a failure of sheet feeding. As described above, when the warpage of the front end is in a certain acceptable range, the recording medium 10 enters between the delivery rollers 7*a* and 7*b*. Since, however, one end of the recording medium is pressed between the delivery rollers 7*a* and 7*b*, causing the recording medium 10 to be lifted from the sheet guide 5. This makes it impossible to ensure a proper space between the recording head 6 and the recording medium 10, leading to a fear of forming an image having an unacceptable poor quality. According to the recording medium 10 of the present invention, the front end thereof is less likely to cause warpage shown in FIG. 10*b*. This effectively prevents the recording medium from being contacted with the recording head, resulting in the formation of an image having an acceptable quality.

Thus, according to the recording medium of the present invention, the warpage of the front end of the recording medium can be effectively prevented, permitting the recording medium 10 to be carried substantially horizontal to the sheet guide S This means that, in the printer used with the recording medium of the present invention, the position of the recording head 6 is not particularly limited. However, in the case of a conventional non-contact type recording head, for example, an ink jet recording head, the distance between the recording medium on the sheet guide 5 and the recording head is about 1 to 5 mm. Regarding the position of the recording head 6, in general, the distance between the point C, where the recording medium 10 is released from the force, created by the sheet feed roller 1, for changing the direction of carrying of the recording medium 10 and the end of the recording head 6 on the side of the sheet feed roller 1 would be suitably about 5 to 30 mm, while the distance between the delivery rollers 7*a* and 7*b* and the end of the recording head 6 on the delivery roller side would be suitably about 5 to 30 mm.

Although the reason why, in the recording medium of the present invention, the warpage of the front end of the recording medium can be effectively prevented has not been elucidated yet, it is believed to reside in the following mechanism. The mechanism described below, however, is based on a mere hypothesis, and the present invention is not limited to this mechanism.

Figure 4:
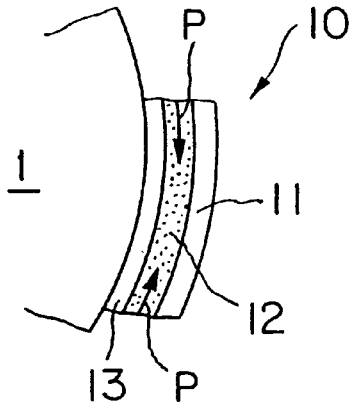
FIG. 4 is a cross-sectional view showing the state of winding of a recording medium 10 around a roller 1.

FIG. 4 is a cross-sectional view showing the state of winding of a recording medium 10 around a roller 1. In the recording medium 10 which becomes curved along the sheet feed roller 1, a difference in inner diameter (i.e., a difference in perimeter) between the recording sheet 11 and the adhesive layer 12 causes compressive force P to act on the adhesive layer 12 along the direction of carrying of the recording medium 10. This compressive force P causes shrinkage of the adhesive layer 12. Thereafter, upon the separation of the recording medium 10 from the sheet delivery roller 1, the compressive force P disappears, resulting in excessive elongation of the adhesive layer 12. According to the recording medium of the present invention, regulation of the Gurley stiffness in combination with the holding power as measured according to a holding power test specified in JIS-Z-0237 is considered to effectively prevent the excessive elongation.

In the present invention, the Gurley stiffness is measured according the procedure set forth in, for example, JIS-L-1096. The testing method will be described in detail.

Figure 6A:
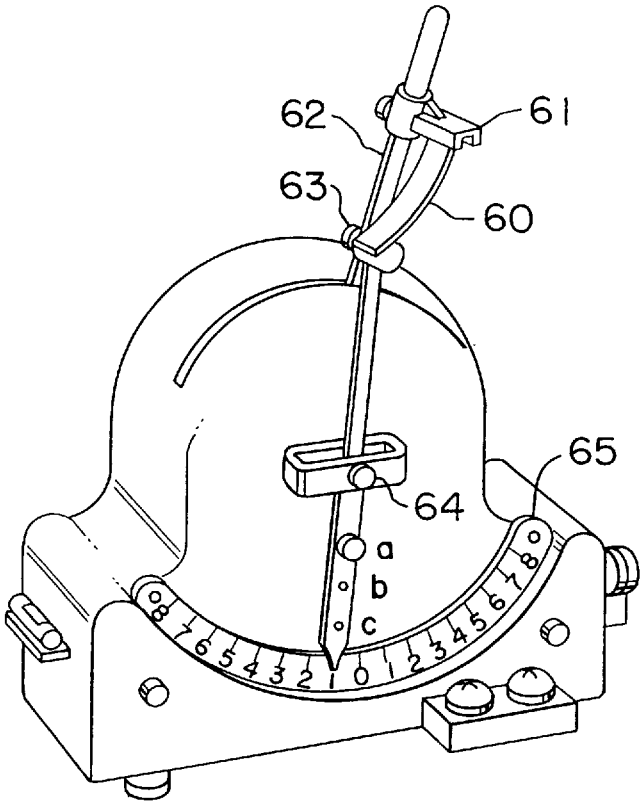
FIG. 6 (*a*) is a diagram showing a Gurley type tester for measuring a Gurley stiffness, and FIG. 6 (*b*) is a diagram showing principal parts of the Gurley type tester shown in FIG. 6 (*a*)
Figure 6B:
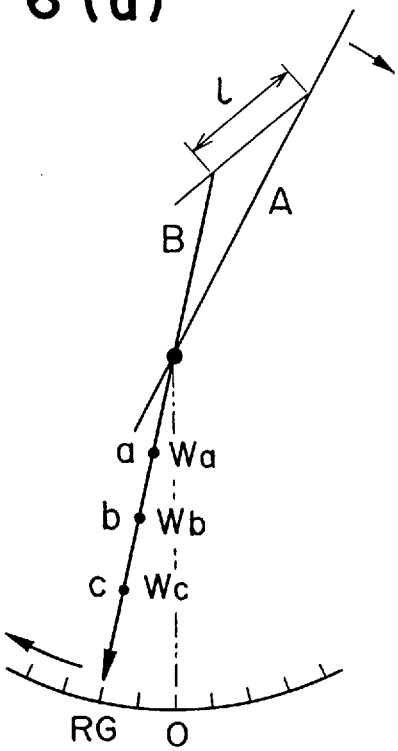

At the outset, five test specimens each having length L cm and width d cm are taken each in the longitudinal and transverse directions of the recording medium. The Gurley stiffness is then measured with a Gurley type tester as shown in FIG. 6 (*a*). FIG. 6 (*b*) is a diagram showing principal parts of the Gurley type tester shown in FIG. 6 (*a*). The specimen 60 is mounted on a chuck 61, and the chuck 61 is fixed to a movable arm 62 while adjusting it to the scale L/2.54 on the arm. Next, suitable weights $W_a$ (g), $W_b$ (g) and $W_c$ (g) are applied to the weight setting holes a, b and c located below the fulcrum 64 of the pendulum 63, and the movable arm 62 is rotated at a fixed rate. The scale RG is read when the specimen 60 separates from the pendulum 63, and the Gurley stiffness is determined by the following equation. The Gurley stiffness is determined for the surface and back of five specimens and expressed to one place of decimals as average each in the longitudinal and transverse directions.

$$\text{Stiffness } (N(mgf)) = RG \times (aW_a + bW_b + cW_c) \times (L^2/d) \times 0.306$$

where a, b, and c represent distances between weight setting hole and fulcrum (cm).

The holding power test according to JIS-Z-0237 will be described in detail.

(1) Test Pieces

Three test pieces of 25 mm in width and approx. 150 mm in length shall be prepared from the specimen.

(2) Test plates

Test plates are made of a SUS 304 steel plate having a thickness of 1.5 to 2.0 mm as specified in JIS G 4305, trimmed to about 50 mm in width and about 125 mm in length. The surface is marked slightly in the crosswise direction of the plate with No. 280 waterproof abrasive paper as specified in JIS R 6253, and then uniformly polished in the lengthwise direction along the whole length until the mark completely vanishes. The surface of test plates is coated with a solvent and wiped with gauze or the like. After drying, plates are wiped again with the specified solvent and wiped thoroughly with new gauze or the like until the surface is dried. The above procedure is repeated 3 or more times until it is deemed clean visually. The solvent used is a suitable one such as hexane, gasoline, ethanol, isopropyl alcohol or toluene. The quality should be reagent grade or industrial grade or superior without residue. The material for wiping is gauze, bleaching, tissue paper or the like which causes neither cutting off nor dropping off of short fibers during use and is free from any additive soluble in the above solvent.

(3) Application device

Figure 7A:
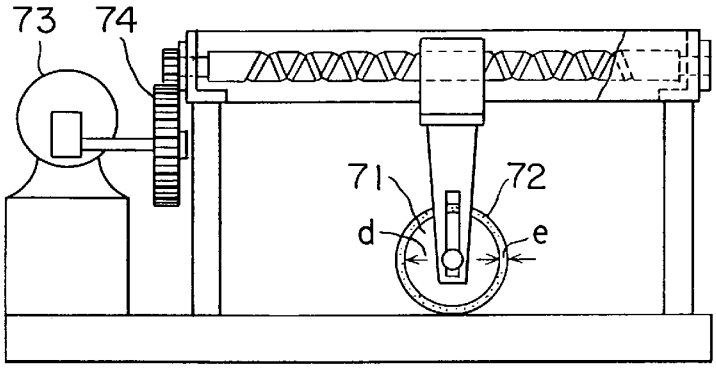
FIG. 7 is an automatic application device used in a holding power test specified in JIS-Z-0237, wherein (*a*) is a general view of the device and (*b*) is an enlarged view of the roller portion shown in (*a*) and wherein numeral 71 designates a roller covered with a rubber layer 72, numeral 73 a motor, and numeral 74 a gear, the roller 71 having a diameter d of about 83 mm and a width 1 of 45 mm, the rubber layer 72 having a thickness e of about 6 mm.
Figure 7B:
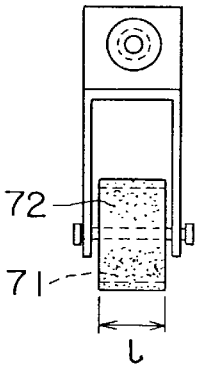
Figure 8:
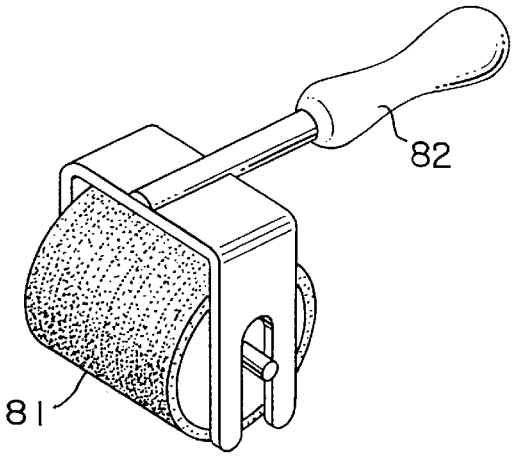
FIG. 8 is a manual application device used in a holding power test specified in JIS-Z-0237, wherein numeral 81 designates a roller and numeral 82 a handle.

The application device may be automatic, as shown in FIG. 7, or manual, as shown in FIG. 8. In any case, the device should have such a construction that, at the time of application of the test piece, only the mass of the roller is applied to the test piece. The mass of the roller shall be 2000 ±50 g.

(4) Method of testing

A test piece is placed onto one end of a cleaned test plate so that a 25×25 mm area of the test piece comes into contact with the plate, and the rest of the test piece is folded with the adhesive surface inside.

A roller is reciprocated five times at a rate of approximately 300 mm/min to adhere.

After 20 min or more, the one end of the test plate is fixed with a fastener to allow the test plate and the test piece to hang perpendicularly, and a weight of 9.807 N is attached to the end of the folded portion. The weight should be gently attached to prevent vibration, and care should be taken so as not to apply force other than the designated weight to the test piece.

The time taken for causing the test pieces to drop from the test plate is measured. The test results are expressed in terms of the time taken for causing the test piece to drop. The test is carried out for three test pieces, and the mean value is determined.

Figure 5:
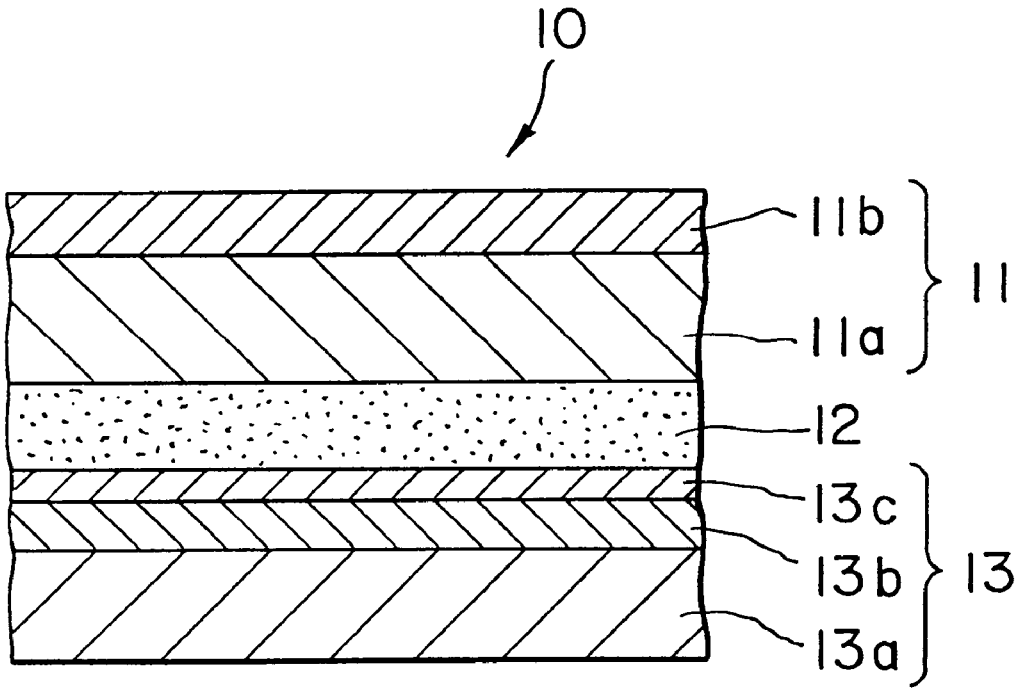
FIG. 5 is a partially enlarged view of the recording medium shown in FIG. 2.

According to one preferred embodiment of the present invention, the recording medium of the present invention has a construction as shown in FIG. 2. FIG. 5 is a partially enlarged cross-sectional view of the recording medium shown in FIG. 2.

As shown in FIG. 5, the recording sheet 11 preferably comprises a substrate 10*a* and a layer lib, receptive to a recording agent, provided on the surface of the substrate.

Suitable sheet materials, for example, wood free and glassine papers, synthetic papers, polyester films, and polypropylene films, may be used as the substrate 10*a*.

The layer 11*b* receptive to a recording agent is a layer which functions to receive a recording agent to be recorded on the recording medium without contact with the recording head. This layer may be suitably selected depending upon the recording agent. For example, in the case of recording using an ink composition from the recording head (for example, ink jet recording method), the layer 11*b* receptive to a recording agent may be an ink-receptive layer which is currently known or will be known in the future, in the art, as a layer for suitably absorbing and holding an ink. The ink-receptive layer may comprise, for example, a pigment and a binder resin and, in addition, various additives. Pigments usable herein include silica, zeolite, calcium carbonate, diatomaceous earth, clay, talc, aluminum oxide, and aluminum hydroxide. Binder resins usable herein include polyvinyl alcohol, polyvinyl pyrrolidone, casein, gelatin, a copolymer of an acrylic ester, polyacrylamide, polyethylene oxide, an ethylene/vinyl acetate copolymer, and cellulose derivatives. Ultraviolet absorbers, preservatives, antioxidants, pH adjustors, surfactants, antifoamers and the like may be added in combination. According to a preferred embodiment of the present invention, the ink-receptive layer is formed by coating a mixture comprising the above ingredients on a substrate 11*a* at a coverage of 0.1 to 50 g/m$^2$ on a dry basis to a total thickness of not less than 80 $\mu$m, preferably about 90 to 250 $\mu$m.

Further, according to a preferred embodiment of the present invention, the recording sheet per se has a Gurley stiffness, preferably a Gurley stiffness in the direction of carrying of the recording sheet in the printer, of about 35 to 700 mgf, more preferably about 100 to 400 mgf.

In the present invention, the adhesive layer 12 is formed of an acrylic polymer. Specifically, the adhesive layer may be of a crosslinked acrylic polymer and comprise a main monomer component, having low Tg, for imparting tackiness, a comonomer component, having high Tg, for imparting an adhesive property and cohesive force, and a polymer or a copolymer, composed mainly of a monomer component containing a functional group, for crosslinking and adhesion improvement purposes.

Main monomer components usable herein include alkyl esters of acrylic acid, such as ethyl acrylate, butyl acrylate, amyl acrylate, 2-ethylhexyl acrylate, octyl acrylate, cyclohexyl acrylate, and benzyl acrylate, and alkyl esters of methacrylic acid, such as butyl methacrylate, 2-ethylhexyl methacrylate, cyclohexyl methacrylate, and benzyl methacrylate.

Comonomer components usable herein include methyl acrylate, methyl methacrylate, ethyl methacrylate, vinyl acetate, styrene, and acrylonitrile.

Functional group-containing monomer components usable herein include carboxyl-containing monomers, such as acrylic acid, methacrylic acid, maleic acid, itaconic acid, and crotonic acid, hydroxyl-containing monomers, such as 2-hydroxyethyl (meth)acrylate, 2-hydroxypropyl (meth) acrylate, and N-methylol acrylamide, acrylamide, methacrylamide, and glycidyl methacrylate.

A crosslinking agent is added to a solution of the above polymer or copolymer.

Crosslinking agents usable herein include isocyanate, epoxy, ethyleneimine, and aluminum chelating crosslinking agents, and a crosslinking agent reactive with a functional group is selected and added. According to the present invention, the requirement for the holding power as measured in JIS-Z-0237 can be satisfied mainly by the kind of the crosslinking agent and the regulation of the amount of the crosslinking agent added.

The coverage of the adhesive is preferably in the range of from 5 to 50 g/m$^2$ (on a dry basis), more preferably in the range of from about 10 to 30 g/m$^2$.

According to a preferred embodiment of the present invention, the release sheet 13 comprises a substrate sheet 13*a,* formed of paper such as wood free or glassine paper, a seal layer 13*b* optionally provided on the substrate sheet 13*a;* and a release agent layer 13*c,* for example, a silicone layer 13*c,* at a coverage of 0.1 to 3 g/m$^2$ coated on the seal layer 13*b.*

The seal layer 13*b* may be formed by lamination or coating of polyethylene, polyvinyl alcohol, clay, alkyd resin or the like to a thickness of 0.5 to 50 gm. It may further be provided also on the backside remote from the release agent-treated face from the viewpoint of preventing curling of the adhesive sheet 10.

Beside paper, a film may be used as the substrate sheet 13*a,* and a polyester or polypropylene film coated with silicone as a release agent may be used.

As shown in FIGS. 1 and 2, preferably, the release sheet 13 is formed in a size slightly larger than the recording sheet 11 and the adhesive layer 12 from the viewpoint of easy separation of the release sheet 13.

A layer for preventing the penetration of an ink may be provided between the ink-receptive layer lib and the substrate sheet 11*a* or between the substrate 11*a* and the adhesive layer 12. Preferably, the layer for preventing the penetration of an ink may be formed of a hydrophobic resin from the viewpoint of preventing the penetration of a water-base ink.

Further, according to a preferred embodiment of the present invention, the release sheet per se has a Gurley stiffness, preferably a Gurley stiffness in the direction of carrying of the recording sheet in the printer, of about 30 to 600 mgf, more preferably about 50 to 200 mgf.

EXAMPLES

Example 1

A precursor composition for an ink-receptive layer was coated at a coverage of 20 g/m$^2$ on one side of a wood-free paper having a basis weight of 100 g/m$^2$, and the coating was dried to prepare a recording sheet (thickness 125 $\mu$m, stiffness 253 mgf).

Separately, a 17 $\mu$m-thick polyethylene film was laminated onto one side of a wood-free paper having a basis weight of 50 g/m$^2$, silicone was coated at a coverage of 0.8 g/m$^2$ on the surface of the laminate, and the coating was dried. Thus, the laminate was treated to render the surface thereof releasable to prepare a release paper.

Coronate L (manufactured by Nippon Polyurethane Industry Co., Ltd.) was added as a crosslinking agent to an acrylic ester copolymer of 97 parts by weight of butyl acrylate with 3 parts by weight of acrylic acid so that the ratio on a solid basis of the copolymer to the crosslinking agent was 100:5.0, following by stirring. The resultant mixture was coated at a coverage of 20 g/m$^2$ on a dry basis on the release paper in its surface which had been rendered releasable, and the coating was then dried. Thereafter, the coated release paper was laminated onto the recording sheet on its surface remote from the ink-receptive layer, thereby preparing a recording medium.

The recording medium thus obtained had a stiffness of 632 mgf.

Example 2

A recording medium was prepared in the same manner as in Example 1, except that the ratio on a solid basis of the acrylic ester copolymer to the crosslinking agent was 100:3.0.

Example 3

A recording medium was prepared in the same manner as in Example 1, except that the ratio on a solid basis of the acrylic ester copolymer to the crosslinking agent was 100:2.0.

Example 4

A recording medium was prepared in the same manner as in Example 1, except that the ratio on a solid basis of the acrylic ester copolymer to the crosslinking agent was 100:1.5.

Example 5

A recording medium was prepared in the same manner as in Example 1, except that the ratio on a solid basis of the acrylic ester copolymer to the crosslinking agent was 100:1.2.

Example 6

A recording medium was prepared in the same manner as in Example 1, except that the ratio on a solid basis of the acrylic ester copolymer to the crosslinking agent was 100:7.0.

Comparative Example 1

A recording medium was prepared in the same manner as in Example 1, except that the ratio on a solid basis of the acrylic ester copolymer to the crosslinking agent was 100:1.0.

recording medium was inspected also for contact with the recording head.

The results were as summarized in Table 1.

TABLE 1

| | | Ex. 1 | Ex. 2 | Ex. 3 | Ex. 4 | Ex. 5 | Ex. 6 | Comp. Ex. 1 | Comp. Ex. 2 | Comp. Ex. 3 |
|---|---|---|---|---|---|---|---|---|---|---|
| Amount of cross-linking agent based on acrylic ester co-polymer (wt % on solid basis) | | 5.0 | 3.0 | 2.0 | 1.5 | 1.2 | 7.0 | 1.0 | 0.8 | 0 |
| Holding powder | Time ta-ken for causing test piece to drop (min) | 500 | Not less than 1,000 | 800 | 550 | 500 | 400 | 420 | 150 | 20 |
| | State of test piece when dropped | Failured at the interface between pressure-sensitive adhesive layer and adherent | Not dropped even after 1,000 min after initia-tion of test | Failured in the pressure-sensitive adhesive layer | Failured in the pressure-sensitive adhesive layer | Failured in the pressure-sensitive adhesive layer | Failured at the interface between pressure-sensitive adhesive layer and adherent | Failured in the pressure-sensitive adhesive layer | Failured in the pressure-sensitive adhesive layer | Failured in the pressure-sensitive adhesive layer |
| Degree (height) of lifting (mm) | | 2.0 | 2.5 | 3.0 | 3.3 | 3.5 | 2.0 | 4.0 | 4.8 | 5.5 |
| Contact with head | | Not contacted | Not contacted | Not contacted | Not contacted | Not contacted | Not contacted | Not contacted | Contacted | Contacted |

Comparative Example 2

A recording medium was prepared in the same manner as in Example 1, except that the ratio on a solid basis of the acrylic ester copolymer to the crosslinking agent was 100:0.8.

Comparative Example 3

A recording medium was prepared in the same manner as in Example 1, except that no crosslinking agent was added.

Holding power test

For the recording media prepared in Examples 1 to 6 and Comparative Examples 1 to 3, a holding power test was carried out according JIS-Z-0237. In the test, when the recording medium was dropped from an adherend, the state of a failure of the adhesive layer was observed.

The test results were as summarized in Table 1.

Test on carriability through within printer

The recording media prepared in Examples 1 to 6 and Comparative Examples 1 to 3 each were cut into a size A4, loaded into an ink jet printer MJ-700V2C (manufactured by Seiko Epson Corporation), and carried through within the printer. This printer substantially has a construction as shown in FIG. 3, wherein a sheet feed roller 1 has a radius of 16 mm and the central angle of the circular arc is 156° . The distance between sheet guide 5 and recording head 6 is 2.5 mm. Immediately after delivery of the recording medium from the sheet feed roller, the carrying of the recording medium was stopped. Then, the height of the recording medium in its front end from a sheet guide, that is, lifting due to the warpage of the adhesive sheet (see h of FIG. 3) was measured, while recording head 6 was at the end of the carrige by which the head was guided. Thereafter, carrying of the recording medium was resumed, and printing on the recording medium was performed to output an image. The

What is claimed is:

1. A recording medium comprising: a recording sheet; an adhesive layer provided on one side of the recording sheet; and a release sheet provided on the adhesive layer, said recording medium having a Gurley stiffness of 200 to 1500 mgf, said adhesive layer comprising a crosslinked acrylic polymer, said recording medium being such that, in a holding power test according to JIS-Z-0237, the time taken for causing a test piece of the recording medium to drop from an adherend is 500 min or more, or when the time taken for causing a test piece of the recording medium to drop from an adherend is less than 500 min, the test piece is dropped as a result of coming off at the interface between the adherend and the adhesive layer.

2. The recording medium according to claim 1, wherein when the time taken for causing a test piece of the recording medium to drop from an adherend, in a holding power test according to JIS-Z-0237, is 500 min or more, the test piece is dropped as a result of coming off within the adhesive layer or as a result of coming off at the interface between the adherend and the adhesive layer.

3. The recording medium according to claim 1, wherein the acrylic polymer is crosslinked by a crosslinking agent selected from the group consisting of isocyanate, epoxy, ethyleneimine, and aluminum chelating crosslinking agents.

4. The recording medium according to claim 1 in combination with a printer, said printer comprising a recording head for recording on the recording medium with the recording head spaced from the recording medium and means for carrying the recording medium and for changing the carrying direction of the recording medium while drawing a circular arc within the printer, the circular arc having a central angle of about 120 to about 200° and a radius of about 10 to about 50 mm.

5. The recording medium according to claim 4, wherein the distance between the recording medium and the recording head is about 1 to about 5 mm.

6. The recording medium according to claim 5, wherein the recording head is an ink jet recording head.

7. The recording medium according to claim 4, wherein when the time taken for causing a test piece of the recording medium to drop from an adherend, in a holding power test according to JIS-Z-0237, is 500 min or more, the test piece is dropped as a result of coming off within the adhesive layer or as a result of coming off at the interface between the adherend and the adhesive layer.

8. The recording medium according to claim 4, wherein the acrylic polymer is crosslinked by a crosslinking agent selected from the group consisting of isocyanate, epoxy, ethyleneimine, and aluminum chelating crosslinking agents.

9. An apparatus comprising the recording medium according to claim 1, and a printer comprising a recording head for recording on the recording medium with the recording head spaced from the recording medium, and means for carrying the recording medium and for changing the carrying direction of the recording medium while drawing a circular arc within the printer, the circular arc having a central angle of about 120 to about 200° and a radius of about 10 to about 50 mm, said means for carrying comprising at least one roller and contact means for maintaining a portion of the recording medium in contact with the at least one roller.

10. A method for recording onto a recording medium, comprising the steps of:

introducing the recording medium according to claims 1 into a printer comprising a recording head for performing recording in non-contact with a recording medium and means for changing the carrying direction of the recording medium while drawing a circular arc within the printer, the circular arc having a central angle of about 120 to about 200° and a radius of about 10 to about 50 mm; and performing recording onto the recording medium by means of the recording head.

11. The recording method according to claim 10, wherein the recording head is an ink jet recording head.

* * * * *